United States Patent [19]

Lonnemo

[11] Patent Number: 4,811,650

[45] Date of Patent: Mar. 14, 1989

[54] POWER TRANSMISSION

[75] Inventor: Kurt R. Lonnemo, Bloomfield Hills, Mich.

[73] Assignee: Vickers, Incorporated, Troy, Mich.

[21] Appl. No.: 90,660

[22] Filed: Aug. 28, 1987

[51] Int. Cl.[4] ..... F15B 11/08

[52] U.S. Cl. ..... 91/461; 91/447; 91/455

[58] Field of Search ..... 91/461, 459, 447, 448, 91/455, 454; 417/219

[56] References Cited

U.S. PATENT DOCUMENTS

| | | | |
|---|---|---|---|
| 2,974,639 | 3/1961 | O'Connor et al. | 91/461 X |
| 3,340,897 | 9/1967 | Nevulis | 91/461 X |
| 4,145,957 | 3/1979 | McClocklin | 91/461 X |
| 4,353,289 | 10/1982 | Lonnemo | 91/461 X |
| 4,509,406 | 4/1985 | Melocik | 91/461 X |
| 4,590,968 | 5/1986 | Wolfges | 91/433 X |

FOREIGN PATENT DOCUMENTS

| | | | |
|---|---|---|---|
| 2363480 | 6/1975 | Fed. Rep. of Germany | 417/219 |

*Primary Examiner*—Edward K. Look

*Attorney, Agent, or Firm*—Barnes, Kisselle, Raisch, Choate, Whittemore & Hulbert

[57] ABSTRACT

A hydraulic control system comprising a hydraulic actuator having opposed openings adapted to alternately function as inlets and outlets for moving the element of the actuator in opposite directions, a pump system for supplying fluid, and a directional valve provided to which the fluid from the pump is supplied for controlling flow to and from the actuator. A pair of lines extends from the directional valve to the respective openings of the actuator. A controller alternately supplies a first fluid pilot pressure to pressure reducing valves associated with the directional valve for reducing the pressure from the pump system or any other source and supplying a second reduced pilot pressure to the directional valve for controlling the flow to and from the actuator. Preferably, the directional valve comprises a meter-in valve and a meter-out valve associated with each line to the actuator for controlling flow out of the actuator. Each meter-in valve and meter-out valve is operated by the second pilot pressure from the pressure reducing valve.

32 Claims, 7 Drawing Sheets

POWER TRANSMISSION

This invention relates to power transmissions and particularly to hydraulic circuits for actuators such as are found on equipment such as which require long hydraulic lines between a controller and a directional valve.

BACKGROUND AND SUMMARY OF THE INVENTION

This invention relates to hydraulic systems for controlling a plurality of actuators such as hydraulic cylinders which are found, for example, in aerial work platforms. In such a system, it is not uncommon to provide a pilot operated directional valve for each actuator which is controlled by a manually operated controller through a pilot hydraulic circuit. The directional valve functions to supply hydraulic fluid to the actuator to control the speed and direction of operation of the actuator. In addition, the directional valve for each actuator controls the flow of hydraulic fluid out of the actuator.

In aerial work platforms and the like, the manually operated controller is on the elevated platform and long pilot lines extend from the source of pilot pressure to the manually operated controller and from the controller to the directional valve. Each function of the valve includes a manually operated controller and respective pilot lines to and from the directional valves. In addition, a common tank line is provided from all of the controllers. Such long lines result in a sluggish response that makes it difficult to precisely position the aerial work platform. The long lines also add weight and are costly. In some instances, dual pilot lines are provided where a second controller is provided at the base of the aerial work platform. The weight of the pilot lines often necessitates the addition of counter weights to the aerial work platform which adds to the difficulty of moving the platform along the terrain.

In such systems where pilot pressure is provided to the directional valve from a remote location, the long pilot pressure hydraulic lines especially at cold temperatures result in a large pilot pressure drop which prevents adequate system response to the hydraulic signal initiated by the controller.

It has heretofore been suggested that the directional valves be controlled by electrohydraulic valves on the directional valve with electric wires extending to a manually operated controller on the aerial work platform. Such systems may include solenoid operated pressure reducing valves that provide a pilot pressure to the directional valve. However, it has been found that in the environment in which such systems are used, as in the case of an aerial work platform, the system is more susceptible to malfunction. Furthermore, the owners of such vehicles are usually lessors and find great difficulty in obtaining skilled personnel for maintaining mechnical, hydraulic and electronic systems. The high frequency repair and difficulty in obtaining qualified personnel for maintenance have resulted in the demand for systems which are exclusively hydraulic for various purposes such as aerial work platforms with the aforementioned problems and difficulties of inadequate response, weight and cost.

Such problems also exist in the hydraulic systems shown in U.S. Pat. Nos. 4,201,052 and 4,480,527, having a common assignee with the present application. The hydraulic systems shown therein are intended to accurately control the position and speed of operation of the actuators. In such systems, the directional valves comprise pilot operated meter-in valves and separate pilot operated meter-out valves. A pilot controller supplies pilot pressure selectively to the meter-in valve to apply pressure to one of the lines of the actuator and to open the meter-out valve of the other line to the actuator. Provision is made for sensing the maximum load pressure in one of a series of valve systems controlling a plurality of actuators and applying the higher pressure to the load sensing pump system. In addition, load drop check valves are provided preventing return flow to the meter-in valve when it is in neutral. Inherent leakage in the meter-in valve can adversely affect the hydraulic signal especially in cold temperatures by providing substantial back pressure.

Among the objectives of the present invention are to provide a system which results in rapid response to a hydraulic signal from a controller for all operating conditions; which overcomes the problems of long pilot lines especially in cold weather; which permits the use of smaller pilot lines and smaller hydraulic controllers thereby reducing the weight and cost; and which in one form provides for smooth starting and stopping of a load and accurate positioning of the load, as in high inertia loads such as swing drives.

In accordance with the invention, a hydraulic control system comprising a hydraulic actuator having opposed openings adapted to alternately function as inlets and outlets for moving the element of the actuator in opposite directions, a pump system for supplying fluid, and a directional valve provided to which the fluid from the pump is supplied for controlling flow to and from the actuator. A pair of lines extends from the directional valve to the respective openings of the actuator. A controller alternately supplies a first fluid pilot pressure to pressure reducing valves associated with the directional valve for reducing the pressure from the pump system or any other source and supplying a second reduced pilot pressure to the directional valve for controlling the flow to and from the actuator. Preferably, the directional valve comprises a meter-in valve and a meter-out valve associated with each line to the actuator for controlling flow out of the actuator. Each meter-in valve and meter-out valve is operated by the second pilot pressure from the pressure reducing valve. In a modified form, novel means are provided for achieving smooth starting and stopping and positioning of a load, as in high inertia load such as swing drives.

DESCRIPTION

Figure 1:
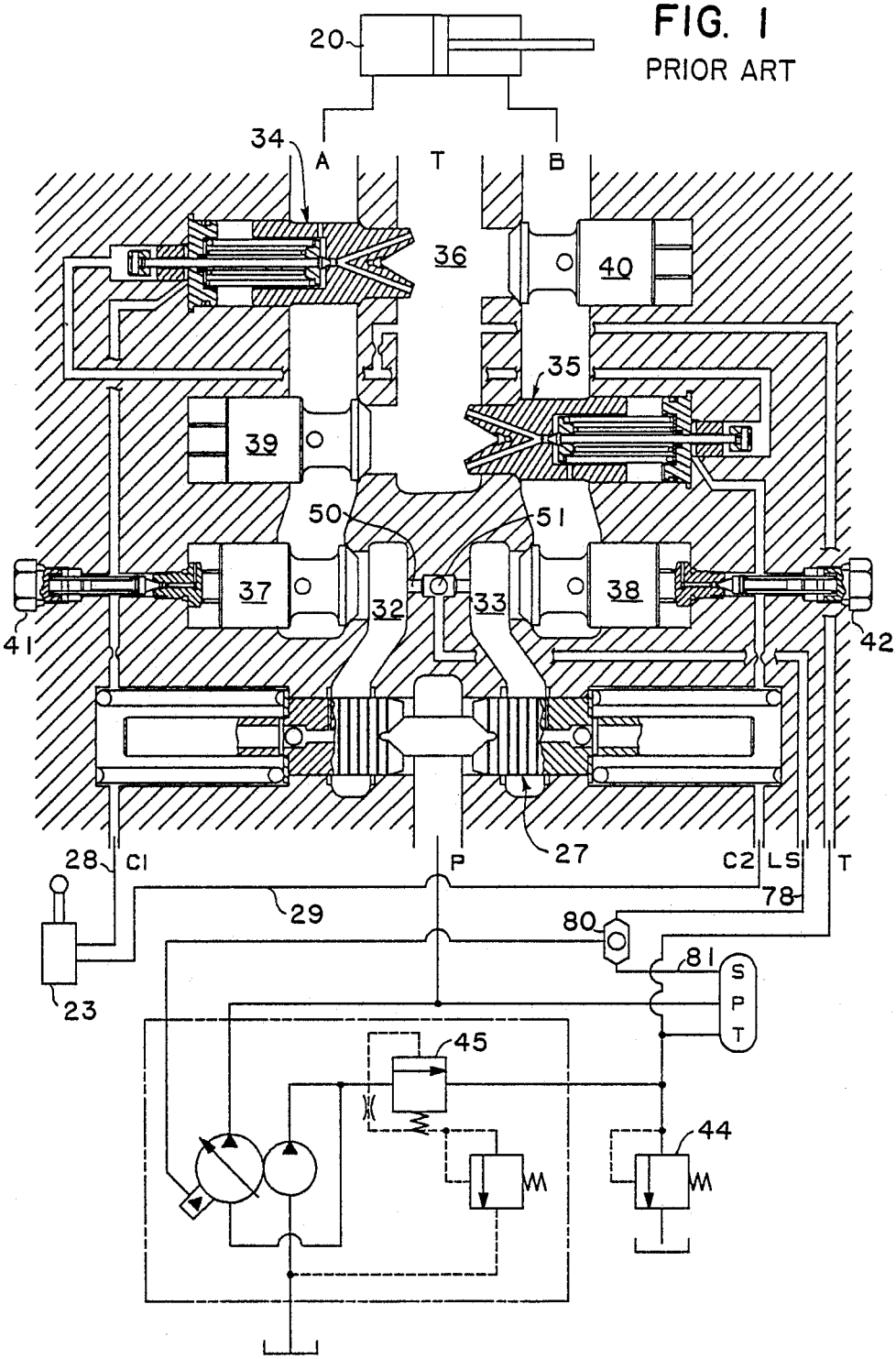
FIG. 1 PRIOR ART
FIG. 1 is a partly schematic sectional view of a hydraulic system in accordance with the prior art.

The invention is particularly applicable to hydraulic systems of the type shown in the aforementioned U.S. Pat. Nos. 4,201,052 and 4,480,527. Referring to FIG. 1, such a prior art hydraulic system is utilized with an actuator 20, herein shown as a linear hydraulic actuator. A load sensing pump control system 22 may comprise a variable displacement control system or a fixed displacement pump including a load sensing relief valve. Fluid from the pump system 22 is directed through a pressure port P to the line 25 to a meter-in valve 27 that functions to direct and control the flow of hydraulic fluid to one or the other of the actuator ports A or B of the actuator 20. The meter-in valve 27 is pilot pressure controlled by a controller 23 through lines 28, 29 which supplies a pilot pressure to opposite ends of meter-in valve 27, as presently described. Depending upon the direction of movement of the valve 27, hydraulic fluid passes through lines 32, 33 to one or the other ports A or B of the actuator 20.

The hydraulic system further includes a meter-out valve 34, 35 associated with each end of the actuator in passages 32, 33 for controlling the flow of fluid from the end of the actuator to which hydraulic fluid is not flowing from the pump to a tank passage 36, as presently described.

The hydraulic system further includes spring loaded poppet or drop check valves 37, 38 in the lines 32, 33 and spring loaded anti-cavitation valves 39, 40 which are adapted to open the lines 32, 33 to the tank passage 36. In addition, spring loaded poppet valves 41, 42 are associated with each meter-out valve 34, 35. A bleed line 47 having an orifice 49 extends from passage 36 to meter-out valves 34, 35 which incorporate check valves through lines 49, 50, respectively.

The system also includes a back pressure valve 44 associated with the return or tank line T. Back pressure valve 44 functions to minimize cavitation when an overrunning or a lowering load tends to drive the actuator down. A charge pump relief valve 45 is provided to take excess flow above the inlet requirement of the pump 22 and apply it to the back pressure valve 44 to augment the fluid available to the actuator.

Meter-in valve 27 comprises a bore in which a spool is positioned and in the absence of pilot pressure is maintained in a neutral position by springs. The spool normally blocks the flow from the pressure passage P to the passages 32, 33. When pilot pressure is applied to either passage $C_1$ or $C_2$, the meter-in spool is moved in the direction of the pressure until a force balance exists among the pilot pressure, the spring load and the flow forces. The direction of movement determines which of the passages 32, 33 is provided with fluid under pressure from passage P.

When pilot pressure is applied to either line $C_1$ or $C_2$, it is also applied to either meter-out valves 34 or 35, so that one of the valves is actuated to throttle flow from the associated end of actuator to tank passage T.

It can thus be seen that the same pilot pressure which functions to determine the direction of opening of the meter-in valve 27 also functions to determine and control the opening of the appropriate meter-out valve 34, 35 so that the fluid in the actuator can return to the tank line.

Provision is made for sensing the maximum load pressure in one of a multiple of valve systems controlling a plurality of actuators and applying that higher pressure to the load sensitive variable displacement pump 22. Each valve system includes a line 50 between passages 32, 33 having a shuttle valve 51 therein that receives pressure from one of the adjacent passages 32, 33 and supplies pressure to a line 79 that extends to a shuttle valve 80 that receives load pressure from an adjacent actuator through a line 81. Shuttle valve 80 senses which of the pressures is greater and shifts to apply the higher pressure to the pump system 22. Thus, each valve system in succession incorporates shuttle valves 80 which compare the load pressure therein with the load pressure of an adjacent valve system and transmit the higher pressure to the adjacent valve system in succession and finally apply the highest load pressure to pump system 22.

The above described circuit is shown and described in U.S. Pat. Nos. 4,201,052 4,407,122, 4,418,612, 4,480,527 and 4,569,272. The single meter-in valve 27 may be replaced by two meter-in valves as described in the aforementioned United States patent.

The details of the preferred construction of the elements of the hydraulic circuit are more specifically described in the aforementioned U.S. Pat. Nos. 4,201,052, 4,407,122, 4,418,612, 4,480,527 and 4,569,722, which are incorporated herein by reference.

Figure 2:
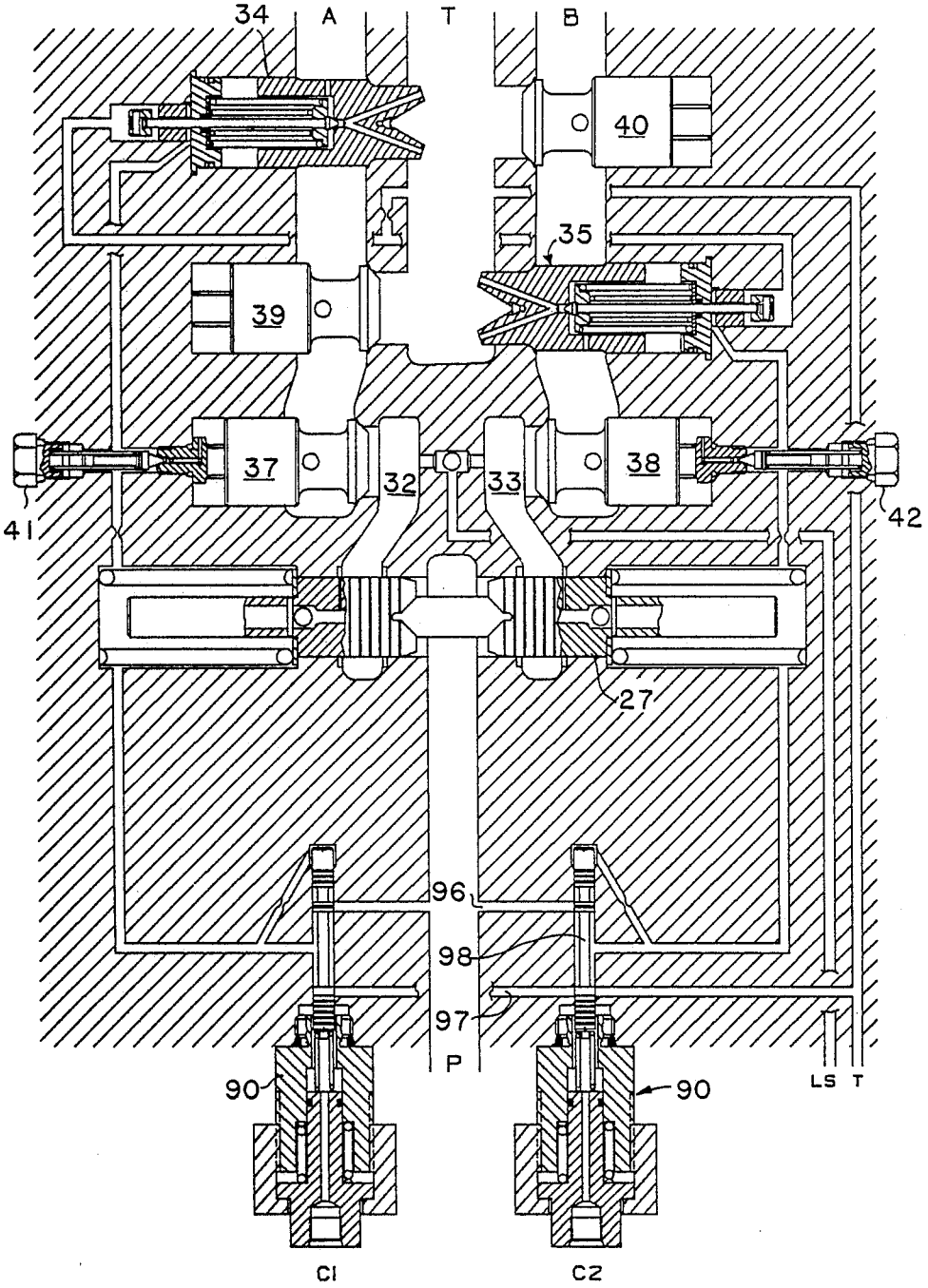
FIG. 2 is a partly schematic sectional view of a hydraulic system embodying the invention.

FIG. 2 is a partly schematic sectional view of a hydraulic system embodying the invention, the elements having corresponding reference numerals where applicable to those of FIG. 1.

In accordance with the invention, as shown in FIG. 2, instead of applying pilot pressure through pilot lines 28, 29 directly to each end of the meter-in valve 27, a first pilot pressure from the pilot controller 22 is applied to pressure reducing valves associated with the respective ends of the meter-in valve 27, as presently described. Each pressure reducing valve 90 is positioned between the pressure from the main pump 22 and the respective ends of the meter-in valve 27 to provide a second reduced pilot pressure from the pump 22 in order to shift the spool of the valve 27 in one direction or the other. The pilot controller 23 supplies a first pilot pressure selectively to the end of one or the other of the reducing valve 90 so that the first pilot pressure pressurizes the pressure reducing valve 90 rather than providing fluid to the end of the meter-in valve 27 sufficient to shift the entire spool of the meter-in valve 27 and meter-out valve 34 or 35.

Figure 3:
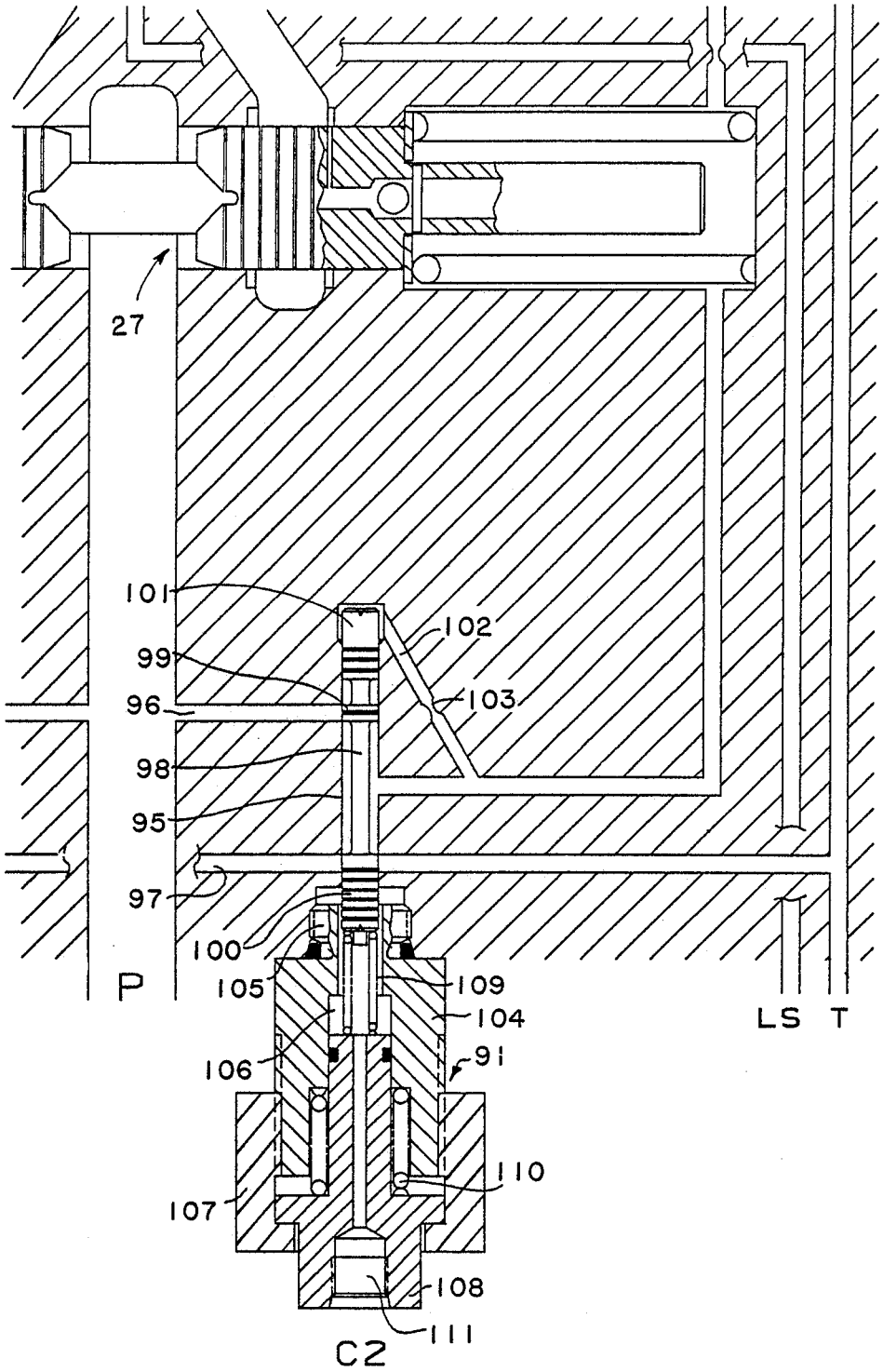
FIG. 3 is a fragmentary sectional view on an enlarged scale of a portion of the system shown in FIG. 2.

As shown in FIG. 3, each pressure reducing valve 90 comprises a body 91 having an opening 111 connected to the respective first pilot pressure line 28 or 29. Opening 111 communicates with a passageway 95 which intersects a first passage 96 extending to the supply line 25. Passageway 95 also intersects a second passage 97 which extends to the tank return line T. A spool 98 is positioned in passageway 95 and has a first small metering land 99 which normally intersects and shuts off first passage 96 when the meter-in valve 27 is in neutral position. Land 99 controls the flow of the second pilot pressure through line **29*a* to one end of the meter-in valve 27. Spool 98 includes a second wider land 100 associated with passage 97 which meters flow between passageway 95 and passage 97 to tank T when the meter-in valve 27 is in neutral position. Spool 98 includes a third land 101 associated with the upper end thereof remote from the inlet to the pressure reducing valve 90. A third passage 102 extends between passageway 95 at the upper end of spool 98 and passage 96 and includes an orifice 103**.

Controller 23 is of conventional construction and comprises a pair of valve control units which are spring loaded to their OFF position wherein they hold the manual control lever in neutral position. Movement of the lever in one of two directions opens the valve control units to direct a first pilot pressure selectively to one or the other of the pressure reducing valves 90.

Body 91 of each pressure reducing valve 90 comprises a first section 104 having a reduced portion 105 threaded into the body of the valve system and having a chamber 106 adjacent the lower end of spool 98. The body 91 includes a second section 107 threaded onto first section 104. A flanged inlet member 108 is provided between member body section 107 and body section 104. Inlet member 108 includes an inlet passage 111 which extends from the respective first pilot pressure line 28 or 29 to the chamber 106. A spring 109 is interposed between the spool 98 and inlet member 108 and yieldingly urges the spool 98 axially inwardly. A second spring 110 is interposed between the body section 104 and the member 108 to urge the member 108 axially outwardly.

Figure 4:
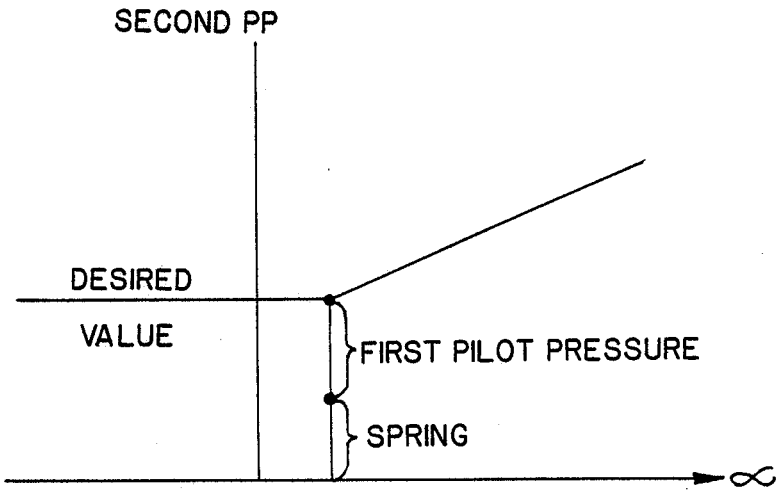
FIG. 4 is a curve of the second pilot pressure versus controlled input (angle).

As the controller 23 is moved to apply a first pilot pressure to the spool 98, the movement of the spool 98 axially inwardly is opposed by the pressure of the fluid in the pilot line 28 or 29. The spring 109 also adds to the force of the first pilot pressure. The required second pilot pressure to move the meter-in valve 27 is thus made up by the first pilot pressure plus the opposing force created by spring 109. This is shown schematically in FIG. 4 which is a curve of second pilot pressure versus controller input or movement which is usually an angular movement of the manual controller. The threshold point is determined by the sum of the force necessary to overcome the preload spring force of the meter-in valve 27 and the dead band of the meter-in valve 27. As the controller 23 is moved to apply pilot pressure, the amount of fluid required is only that to pressurize the pilot line and to shift the pressure reducing valve with a miniscule amount of fluid to permit a portion of the fluid from the main pump 22 to be applied to one end or the other of the meter-in valve 27 and to one of the meter-out valves 34, 35.

A feature of the pressure reducing valve shown in FIGS. 2 and 3 is the arrangement wherein the threshold point can be adjusted. This is achieved by threading the portion 107 on the portion 104 to the change force of the spring 109. This permits adjustment of the pressure reducing valve in the field in order to change the threshold of each part of the system which is controlled by each of the pressure reducing valves independently of the other part of the system. Thus, the adjustment of the spring force makes it possible to adjust for tolerances in the pilot controller and the directional valve in order to adjust the threshold to minimize dead band. Such adjustment is achieved at low cost thereby providing a more efficient hydraulic system.

In accordance with the invention, it is possible to utilize a controller positioned remotely from the valves being controlled and at the same time obviating the problems heretofore inherent, namely, slow response at cold temperatures. In addition, it is possible to provide a hydraulic system which requires long connecting hoses of much lesser diameter which are less costly and occupy less space. Moreover, the system provides for individual adjustment of the system when it is in place thereby enlarging flexibility of the system.

Figure 5:
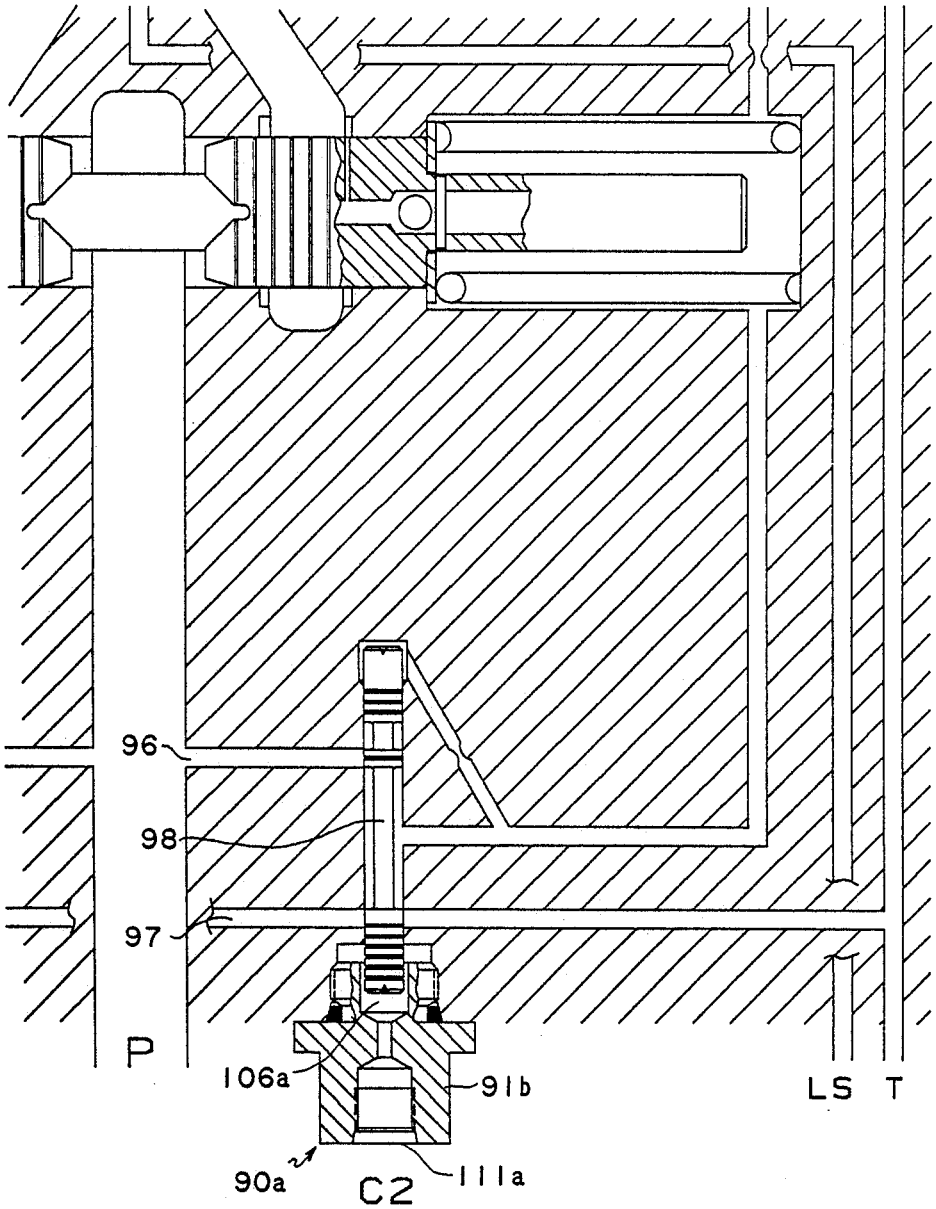
FIG. 5 is a partly schematic sectional view of a portion of a modified form of a hydraulic system embodying the invention.

Referring to FIG. 5, where an adjustment is not needed, the body **91*b* of pressure reducing valve 90*a* can be provided in one section with an inlet 111*a* extending to chamber 106*a***.

Figure 6:
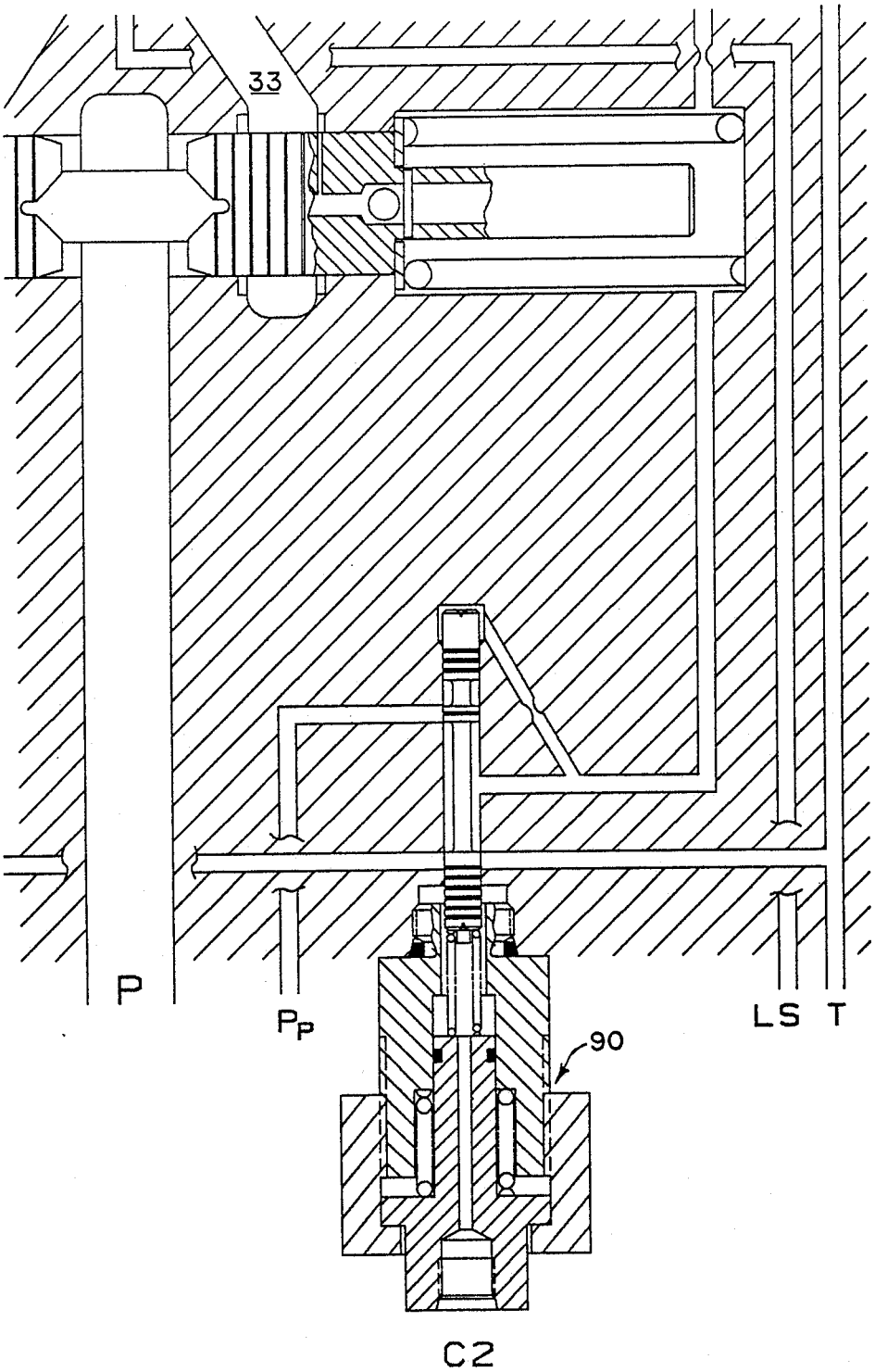
FIG. 6 is a partly schematic sectional view of a further modified form of hydraulic system embodying the invention.

Referring to FIG. 6, pilot pressure need not be obtained from the main supply line P but can be obtained from any other source $P_P$ providing fluid to each pressure reducing valve 90.

Figure 7:
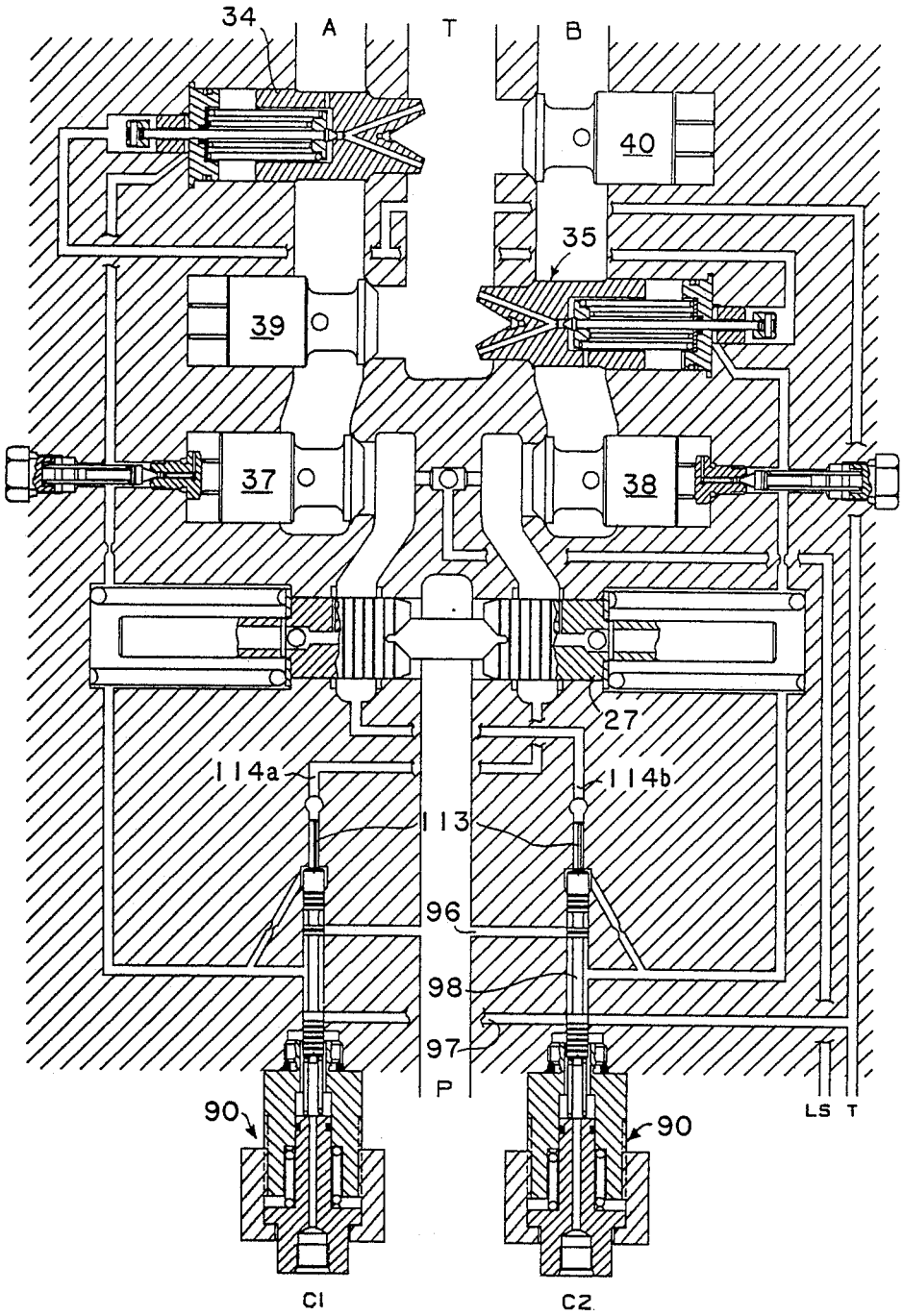
FIG. 7 is a partly schematic sectional view of a further modified form of hydraulic system embodying the invention utilized on swing drives.

In the modified form of system shown in FIG. 7, provision is made for providing a smooth stopping and starting of the load and accurate positioning of the load in high inertia load situations such as swing drives on an excavator. This is achieved by providing a pin or piston 113, is interposed between the end of the spool and a line **114*a* extending from the end of passage 95 associated with pressure reducing valve 90 to the passage 33. A similar passage 114*b* extends from the passage 95 of the pressure reducing valve 90 to passage 32. In operation, when, for example, the pilot controller is operated to shift the spool of meter-in valve 27 to the left in a direction such that pressure is applied to port B of the actuator and the meter-out valve 34 associated with port A is opened, the pressure of fluid from port A is applied through line 114*b* tending to move the spool 98 in a direction to reduce the pilot pressure through line 29*a* and causing the meter-in spool to be moved in a centering direction. This tends to center the spool of the meter-in valve 27. By this arrangement, the function of the meter-in valve 27** is changed from load flow control to load pressure control. Thus, it is possible to obtain smooth starting and stopping and accurate loading under high inertia loads. By this arrangement, it is possible to achieve a similar control as in U.S. Pat. No. 4,407,122.

The arrangement of FIG. 7 thus permits improved control of the swing drive. By changing the rate of the spring and the pressure reducing valve, it is possible to modify the swing drive to obtain a more steep or less steep characteristic of pressure versus flow. It can be appreciated where load pressure control is required in only one direction, the pressure tending to oppose the centering of the meter-in valve spool can be applied to one side only of the hydraulic system.

Although the invention has been particularly described in connection with systems utilizing separate meter-in valves and meter-out valves, it is also applicable to directional valves that incorporate a single spool that functions to control meter-in flow and meter-out flow and is pilot pressure operated.

It can thus be seen that there has been provided a system which overcomes the problems of long pilot lines especially in cold weather; which permits the use of smaller pilot lines and smaller hydraulic controllers thereby reducing the weight and cost; which results in rapid response to a hydraulic signal from a controller for all operating conditions; and which in one form provides for smooth starting and stopping of a load and accurate positioning of the load, as in high inertia loads such as swing drives on an excavator.

What is claimed is:

1. A hydraulic control system comprising a hydraulic actuator having opposed openings adapted to alternately function as inlets and outlets for moving the element of the actuator in opposite directions, a pump for supplying fluid to said actuator, a directional valve to which the fluid from the pump is supplied, said valve being pilot pressure controlled, a pair of lines extending from said directional valve to said respective openings of said actuator, a pair of pressure reducing valves, a pilot controller for alternately supplying fluid at said first pilot pressure to said reducing valves for controlling the direction of movement of the directional valve, each said reducing valve being connected to a source and operable by said first pilot pressure to apply a second pilot pressure to control movement of the directional valve, a pair of lines extending from the pressure valves to said directional valve for applying said second pilot pressure from said pressure reducing valve to said directional valve for controlling the direction and movement of said directional valve, said pressure reducing valve including adjustable spring means for adjusting the second pilot pressure for tolerances in the pilot controller as well as in the directional valve to adjust the threshold and minimize the lead band, said pressure reducing valve including a first body section, a second body section threaded on said first body section, an inlet member having an opening therethrough communicating with the passageway in the first body section to one end of the spool, said spring means being interposed between said one end of the spool and said inlet member such that rotation of the second body section relative to the first body section adjusts the spring force on the end of the spool.

2. The hydraulic system set forth in claim 1 including second spring means yieldingly urging the inlet member axially outwardly relative to aid first body section into engagement with said second body section.

3. The hydraulic system set forth in claim 1 wherein said second pilot pressure comprises a portion of the fluid being supplied by the pump.

4. The hydraulic system set forth in claim 1 wherein the second pilot pressure comprises a source other than that supplied by the pump.

5. The hydraulic system set forth in claim 1 wherein said pressure reducing valve comprises a spool having one end subjected to the first pilot pressure, a passage extending from each end of the meter-in valve to the valve spool of the pressure reducing valve, a second passage extending from the first passage to the other end of the spool such that movement of the spool of the pressure reducing valve by the first pilot pressure applies the second pilot pressure to the directional valve.

6. The hydraulic system set forth in claim 1 including a line extending from at least one said pressure reducing valve to one of said pair of lines extending to the actuator and a piston in said one line for applying a force to the reducing valve when fluid is supplied for shifting the directional valve.

7. The hydraulic system set forth in claim 1 including a first line extending from one said pressure reducing valve to one of said pair of lines extending to the actuator and a piston in said line for applying a force to the reducing valve when fluid is supplied for shifting the directional valve and a second line extending from the other said pressure reducing valve to the other line extending to the actuator and a piston tending to apply a force to said directional valve in the other direction when fluid is supplied for shifting the meter-in valve in the other direction.

8. A hydraulic control system comprising a hydraulic actuator having opposed openings adapted to alternately function as inlets and outlets for moving the element of the actuator in opposite directions, a pump for supplying fluid to said actuator, a meter-in valve means to which the fluid from the pump is supplied, said meter-in valve being pilot pressure controlled, a pair of lines extending from said meter-in valve means to said respective openings of said actuator, a meter-out valve means connected to each of the outlets of the actuator, each said meter-out valve means being pilot pressure controlled, a pair of pressure reducing valves, a pilot controller, a first pair of lines extending from said pilot controller to said reducing valves, said pilot controller being normally closed and being connected to a source of first pilot pressure such that when the pilot controller is actuated, said first pilot pressure is applied to one or the other of said second pair of lines for alternately supplying fluid at said first pilot pressure to said reducing valves for controlling the direction of movement of the meter-in valve means, each said reducing valve being connected to a source and operable by said first pilot pressure to apply a second pilot pressure to control movement of the meter-in valve means and the respective meter-out valve means, a second pair of lines extending from the pressure valves to said meter-in valve means for applying said second pilot pressure from said pressure reducing valve to said meter-in valve means for controlling the direction and movement of said meter-in valve means, said pressure reducing valve including adjustable spring means for adjusting the pilot pressure for differences in tolerances in the pilot controller as well as in the meter-in valve means to adjust the threshold and minimize the dead band, said pressure reducing valve including a first body section, a second body section threaded on said first body section, an inlet member having an opening therethrough communicating with the passageway in the first body section to one end of the spool, said spring means being interposed between said one end of the spool and said inlet member such that rotation of the second body section relative to the first body section adjusts the spring force on the end of the spool.

9. The hydraulic system set forth in claim 8 including second spring means yieldingly urging the inlet member axially outwardly relative to said first body section into engagement with said second body section.

10. The hydraulic system set forth in claim 8 wherein said second pilot pressure comprises a portion of the fluid being supplied by the pump.

11. The hydraulic system set forth in claim 8 wherein the second pilot pressure comprises a source other than the pump.

12. The hydraulic system set forth in claim 8 wherein said pressure reducing valve comprises a spool having one end subjected to the first pilot pressure, a passage extending from each end of the meter-in valve means to the valve spool of the pressure reducing valve, a second passage extending from the first passage to the other end of the spool such that movement of the spool of the pressure reducing valve by the first pilot pressure applies the second pilot pressure to the meter-in valve means.

13. The hydraulic system as set forth in claim 8 including a line extending from at least one said pressure reducing valve to one of said pair of lines extending to the actuator and a piston in said one line for applying a force to the reducing valve means when fluid is supplied for shifting the meter-in valve means.

14. The hydraulic system set forth in claim 8 including a first line extending from one said pressure reducing valve to one of said pair of lines extending to the actuator and a piston in said line one for applying a force to the reducing valve means when fluid is supplied for shifting the meter-in valve means and a second line extending from the other said pressure reducing valve to the other line extending to the actuator and a piston for applying a force to said meter-in valve means in the other direction when fluid is supplied for shifting the meter-in valve in the other direction.

15. The hydraulic control system comprising a hydraulic actuator having opposed openings adapted to alternately function as inlets and outlets for moving the element of the actuator in opposite directions, a pump for supplying fluid to said actuator, a directional valve to which the fluid from the pump is supplied, said valve being pilot pressure controlled, a first pair of lines extending from said directional valve to said respective openings of said actuator, a pair of pressure reducing valves, a pilot controller, a first pair of lines extending from said pilot controller to said reducing valves, said pilot controller being connected to a source of first pilot pressure and being normally closed such that when the pilot controller is actuated, said first pilot pressure is applied to one or the other of said first pair of lines for alternately supplying said first pilot pressure to said reducing valves for controlling the direction of movement of the directional valve, each said reducing valve being connected to a source of a second pilot pressure, each said reducing valve being operable by said first pilot pressure to apply said second pilot pressure to control movement of the directional valve, a second pair of lines extending from the pressure reducing valves to said directional valve for applying said second pilot pressure from said pressure reducing valve to said directional valve for controlling the direction and movement of said directional valve.

16. The hydraulic system set forth in claim 15 wherein said pressure reducing valve includes adjustable spring means for adjusting the second pilot pressure for tolerances in the pilot controller as well as in the directional valve to adjust the threshold and minimize the dead band.

17. The hydraulic set forth in claim 16 wherein said pressure reducing valve includes a first body section, a second body section threaded on said first body section, an inlet member having an opening therethrough communicating with the passageway in the first body section to one end of the spool, said spring means being interposed between said one end of the spool and said inlet member such that rotation of the second body section relative to the first body section adjusts the spring force on the end of the spool.

18. The hydraulic system set forth in claim 17 including second spring means yieldingly urging the inlet member axially outwardly relative to said first body section into engagement with said second body section.

19. The hydraulic system set forth in claim 15 wherein said second pilot pressure comprises a portion of the fluid being supplied by the pump.

20. The hydraulic system set forth in claim 15 wherein the second pilot pressure comprises a source other than that supplied by the pump.

21. The hydraulic system set forth in claim 15 wherein said pressure reducing valve comprises a spool having one end subjected to the first pilot pressure, a passage extending from each end of the meter-in valve to the valve spool of the pressure reducing valve, a second passage extending from the first passage to the other end of the spool such that movement of the spool of the pressure reducing valve by the first pilot pressure applies the second pilot pressure to the directional valve.

22. The hydraulic system set forth in claim 15 including a line extending from at least one said pressure reducing valve to one of said pair of lines extending to the actuator and a piston in said one line for applying a force to the reducing valve when fluid is supplied for shifting the directional valve.

23. The hydraulic system set forth in claim 15 including a first line extending from one said pressure reducing valve to the one of said first pair of lines extending to the actuator and a piston in said line for applying a force to the reducing valve when fluid is supplied for shifting the directional valve and a second line extending from the other said pressure reducing valve to the other line extending to the actuator and a piston in said other line of said first pair of lines for applying a force to said directional valve in the other direction when fluid is supplied for shifting the meter-in valve in the other direction.

24. A hydraulic control system comprising a hydraulic actuator having opposed openings adapted to alternately function as inlets and outlets for moving the element of the actuator in opposite directions, a pump for supplying fluid to said actuator, a meter-in valve means to which the fluid from the pump is supplied, said meter-in valve means being pilot pressure controlled, a pair of lines extending from said meter-in valve means to said respective openings of said actuator, a meter-out valve means connected to each of the outlets of the actuator, each said meter-out valve means being pilot pressure controlled, a pair of pressure reducing valves, a pilot controller, a pair of lines extending from said pilot controller to said reducing valves, said pilot controller being connected to a source of first pilot pressure and being normally closed such that when the pilot controller is actuated, said first pilot pressure is applied to one or the other of said first pair of lines for alternately supplying fluid at said first pilot pressure to said reducing valves for controlling the direction of movement of the meter-in valve means, each said reducing valve being connected to a source of a second pilot pressure, each said reducing valve being operable by said first pilot pressure to apply said second pilot pressure to control movement of the directional valve, a pair of lines extending from the pressure reducing valves to said directional valve for applying said second pilot pressure from said pressure reducing valve to said directional valve for controlling the direction and movement of said directional valve.

25. The hydraulic system set forth in claim 24 wherein said pressure reducing valve includes adjustable spring means for adjusting the pilot pressure for differences in tolerances in the pilot controller as well as in the meter-in valve means to adjust the threshold and minimize the dead band.

26. The hydraulic system set forth in claim 25 wherein said pressure reducing valve includes a first body section, a second body section threaded on said first body section, an inlet member having an opening therethrough communicating with the passageway in the first body section to one end of the spool, said spring means being interposed between said one end of the spool and said inlet member such that rotation of the second body section relative to the first body section adjusts the spring force on the end of the spool.

27. The hydraulic system set forth in claim 24 including second spring means yieldingly urging the inlet member axially outwardly relative to said first body section into engagement with said second body section.

28. The hydraulic system set forth in claim 24 wherein said second pilot pressure comprises a portion of the fluid being supplied to the pump.

29. The hydraulic system set forth in claim 24 wherein the second pilot pressure comprises a source other than the pump.

30. The hydraulic system set forth in claim 24 wherein said pressure reducing valve comprises a spool having one end subjected to the first pilot pressure, a passage extending from each end of the meter-in valve means to the valve spool of the pressure reducing valve, a second passage extending from the first passage to the other end of the spool such that movement of the spool of the pressure reducing valve by the first pilot pressure applies the second pilot pressure to the meter-in valve means.

31. The hydraulic system set forth in claim 24 including a line extending from at least one said pressure reducing valve to one of said pair of lines extending to the actuator and a piston in said one line for applying a force to the reducing valve means when fluid is supplied for shifting the meter-in valve means.

32. The hydraulic system set forth in claim 24 including a first line extending from one said pressure reducing valve to one said first pair of lines extending to the actuator and a piston in said one line for applying a force to the reducing valve means when fluid is supplied for shifting the meter-in valve means and a second line extending from the other said pressure reducing valve to the other line extending to the actuator and a piston in said other line of said first pair of lines for applying a force to said meter-in valve means in the other direction when fluid is supplied for shifting the meter-in valve means in the other direction.

* * * * *